US007336235B2

(12) United States Patent
Sano

(10) Patent No.: US 7,336,235 B2
(45) **Date of Patent: *Feb. 26, 2008**

(54) ANTENNA HAVING A CORE MATERIAL OF LAMINATED THIN MAGNETIC PLATES THAT ARE DIVIDED TO BE WIDER AT END PORTIONS OF THE CORE MATERIAL

(75) Inventor: Takashi Sano, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 150 days.

This patent is subject to a terminal disclaimer.

(21) Appl. No.: 11/156,694

(22) Filed: Jun. 20, 2005

(65) Prior Publication Data

US 2005/0248493 A1 Nov. 10, 2005

Related U.S. Application Data

(63) Continuation of application No. 10/675,607, filed on Sep. 29, 2003, now Pat. No. 6,987,490.

(30) Foreign Application Priority Data

Oct. 3, 2002 (JP) ..... 2002-291170

(51) Int. Cl.
*H01Q 7/08* (2006.01)
*H01Q 1/12* (2006.01)

(52) U.S. Cl. ..... 343/788; 343/718

(58) Field of Classification Search ..... 343/787, 343/788, 718, 702
See application file for complete search history.

(56) References Cited

U.S. PATENT DOCUMENTS

| | | | | |
|---|---|---|---|---|
| 4,873,527 | A * | 10/1989 | Tan | 343/718 |
| 5,220,339 | A | 6/1993 | Matsushita | |
| 5,686,518 | A * | 11/1997 | Fontenot et al. | 524/458 |
| 6,577,284 | B1 | 6/2003 | Conti | |
| 6,987,490 | B2 * | 1/2006 | Sano | 343/788 |
| 2003/0107523 | A1 | 6/2003 | Yahata et al. | |

FOREIGN PATENT DOCUMENTS

| | | | |
|---|---|---|---|
| JP | 37-10108 | | 8/1962 |
| JP | 2001-337181 | A | 12/2001 |
| JP | 2002-204122 | A | 7/2002 |
| JP | 2002204122 | * | 7/2002 |

* cited by examiner

*Primary Examiner*—Hoanganh Le
(74) *Attorney, Agent, or Firm*—Frishauf, Holtz, Goodman & Chick, P.C.

(57) ABSTRACT

An antenna having: a core material which is formed by laminating a plurality of thin plates made of a magnetic material, both end portions of the core material being widened in a thickness direction; and a coil which is wound around the core material.

6 Claims, 9 Drawing Sheets

ANTENNA HAVING A CORE MATERIAL OF LAMINATED THIN MAGNETIC PLATES THAT ARE DIVIDED TO BE WIDER AT END PORTIONS OF THE CORE MATERIAL

CROSS-REFERENCE TO RELATED APPLICATIONS

The present application is a continuation application of U.S. application Ser. No. 10/675,607, filed Sep. 29, 2003 now U.S. Pat. No. 6,987,490.

BACKGROUND OF THE INVENTION

1. Field of the Invention

The present invention relates to an antenna for small size electronic equipment.

2. Description of Related Art

As earlier developed electronic equipment that utilizes electric wave information by receiving the electric wave, there is an electronic wristwatch that performs time adjustment automatically by receiving electronic wave of the standard time.

As an antenna provided in such an electronic wristwatch to receive the electric wave, it has been known to form an antenna by winding a coil on a core material which comprises a magnetic material with a good reception sensitivity such as ferrite, amorphous or the like as disclosed in Japanese Patent Laid-Open Publication No. 2001-337181.

It has also been known that the reception sensitivity of an antenna is affected by the shape of the core material and is improved when both ends of the core material are enlarged. For example, the both ends of the core material can be easily enlarged by a molding that has certain degree of freedom in designing the shape, so that the reception sensitivity can be improved.

However, for example, when the core material is formed by laminating a plurality of thin plates made of the magnetic material or binding a plurality of wire rods made of the magnetic material, the degree of freedom in designing the shape is limited. Thus, a thickness of the core material is constant and the optimization of the shape of the core material to the reception sensitivity has not been accomplished.

SUMMARY OF THE INVENTION

An object of the present invention is to provide an antenna that has an improved reception sensitivity by using a core material which is made of magnetic material.

In order to solve the above-described problem, the antenna according to the invention comprises:

a core material which is formed by laminating a plurality of thin plates made of a magnetic material, both end portions of the core material being widened in a thickness direction; and a coil which is wound around the core material.

According to the invention, the core material of the antenna is formed by laminating a plurality of the thin plates made of the magnetic material, and the both ends of the core material are widened in the thickness direction. Thus, the thickness of the both ends of the core material becomes larger than that of a central portion, so that the reception sensitivity of the electric wave can be improved.

PREFERRED EMBODIMENT OF THE INVENTION

Hereinafter, the preferred embodiments of the present invention will be described in detail by reference to the attached drawings.

Figure 1:
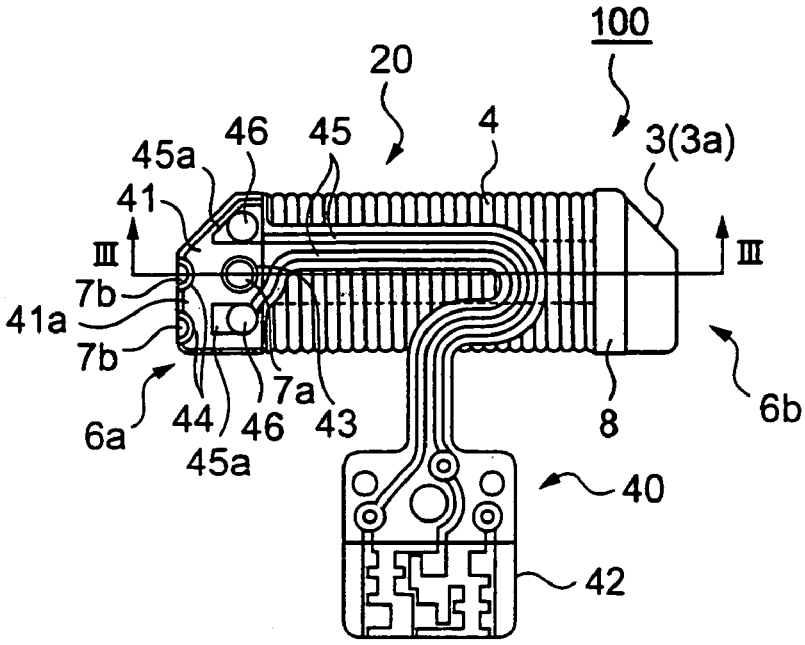
FIG. 1 is a front view of an antenna according to the present invention.
Figure 2:
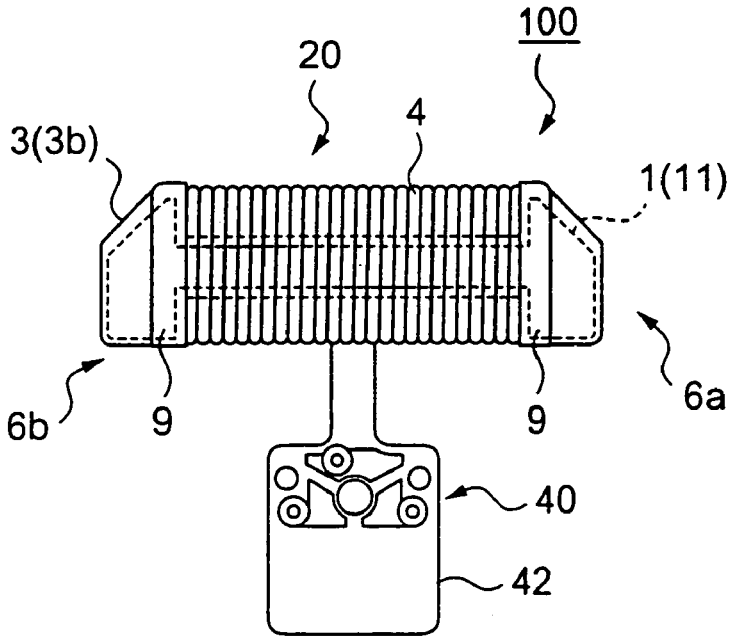
FIG. 2 is a rear view of the antenna in FIG. 1.
Figure 3:
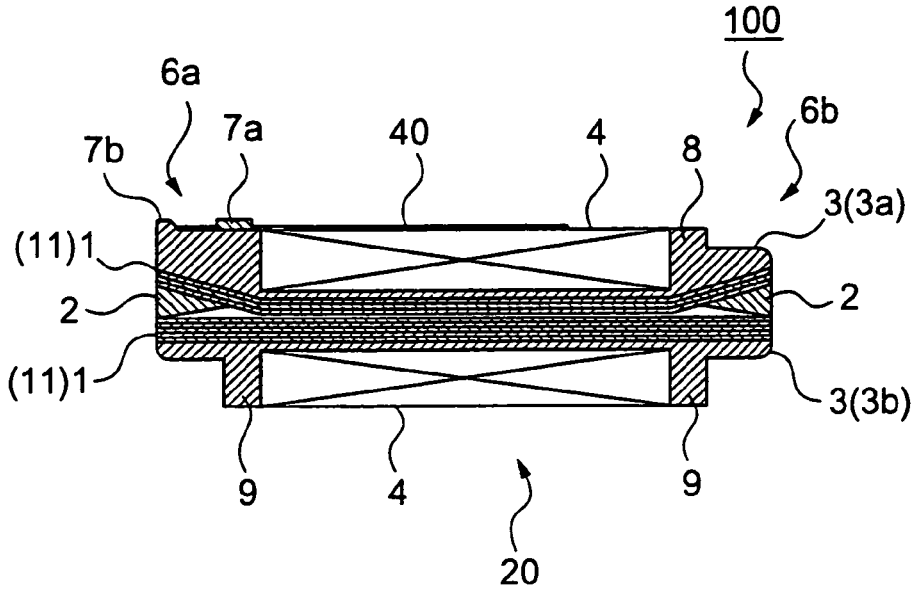
FIG. 3 is a section view taken along the line III-III of FIG. 1.

FIG. 1 is a front view of an antenna according to the present invention, FIG. 2 is a rear view of the antenna, and FIG. 3 is a section view taken along the line III-III of FIG. 1.

As shown in FIGS. 1-3, an antenna 100 comprises an antenna body 20, a connection member 40 for electrically connecting the antenna body 20 with a breadboard (not shown) of electronic equipment and the like.

The antenna body 20 comprises a core material 11 which is formed by laminating a plurality of thin plates 1 comprising a magnetic material, a spacer 2 which is sandwiched between the predetermined thin plates at both end portions of the core material 11 in a longer direction, a core material case 3 for containing the core material 11 therein, a coil 4 which is wound around the core material case 3 or the like.

Figure 4A:
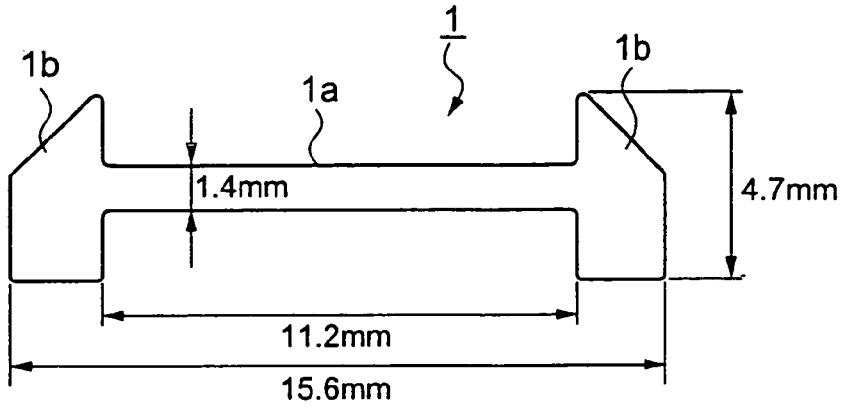
FIG. 4A is a plan view showing a thin plate that forms a core material of the antenna of the present invention.
Figure 4B:
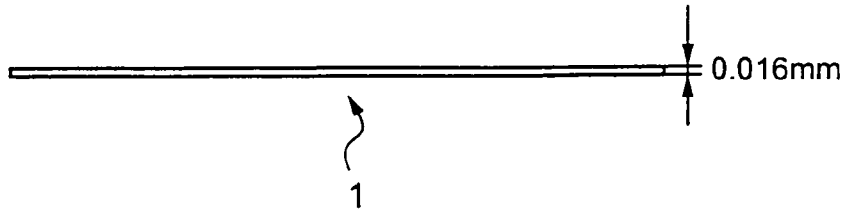
FIG. 4B is a side view of the thin plate in FIG. 4A.

The thin plate 1, as shown in FIG. 4, comprises a core central portion 1*a* and a core end portion 1*b* that is formed at both ends of the core central portion 1*a* in longer direction. The thin plate 1 is an approximately H-shaped thin plate member from the plan view and is made of amorphous which is a magnetic material. A width of the thin plate 1 at the core end portion 1*b* in shorter direction is wider than a width of that at the core central portion 1*a*. Each core end portion 1*b* has a shape comprising an inclined portion which is formed by cutting diagonally one corner of an approximately rectangle.

An example of a specific dimension of the thin plate 1 is as follows. The thickness is 0.016 mm, the length in the longer direction is 15.6 mm, the length of the core central portion 1*a* in the longer direction is 11.2 mm, the width of the core central portion 1*a* in the shorter direction is 1.4 mm, and the width of the core end portion 1*b* is 4.7 mm.

A plurality of the above-described thin plates 1 is laminated to form the core material 11.

The spacer 2 is a wedge shaped member, which is placed between predetermined thin plates 1 at both end portions thereof and sandwiched when the thin plate 1 is laminated. Thus, the core end portions 1*b* that are the both end portions of the thin plate 1 are widened in the thickness direction.

Figure 5A:
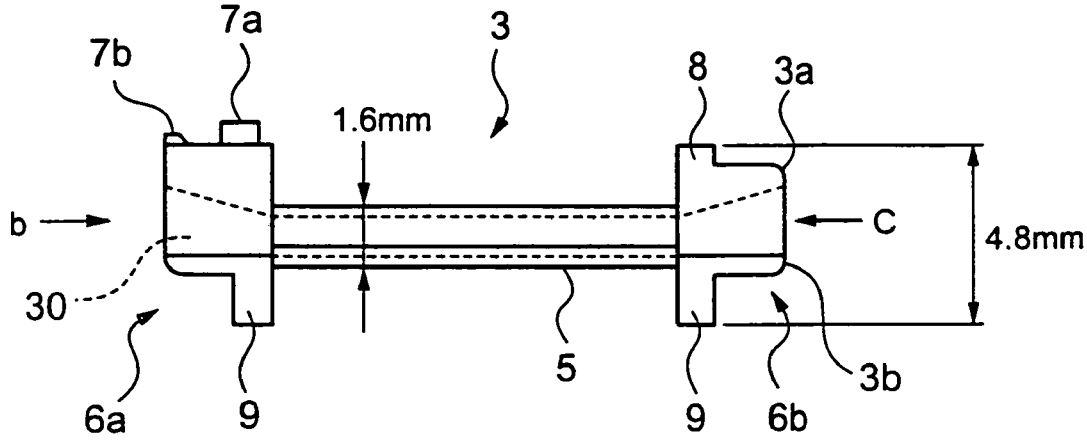
FIG. 5A is a side view showing a core material case which is used for the antenna of the present invention.
Figure 5B:
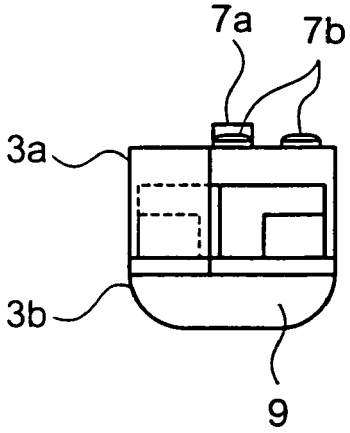
FIG. 5B is a transverse side view of FIG. 5B seen from the direction of the arrow b.
Figure 5C:
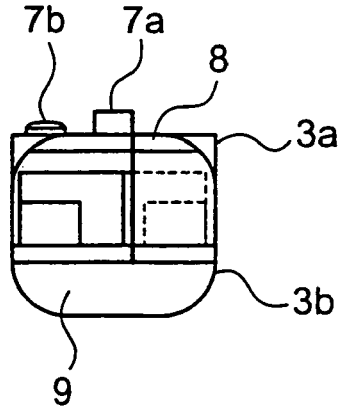
FIG. 5C is a transverse side view of FIG. 5A seen from the direction of the arrow c.
Figure 6A:
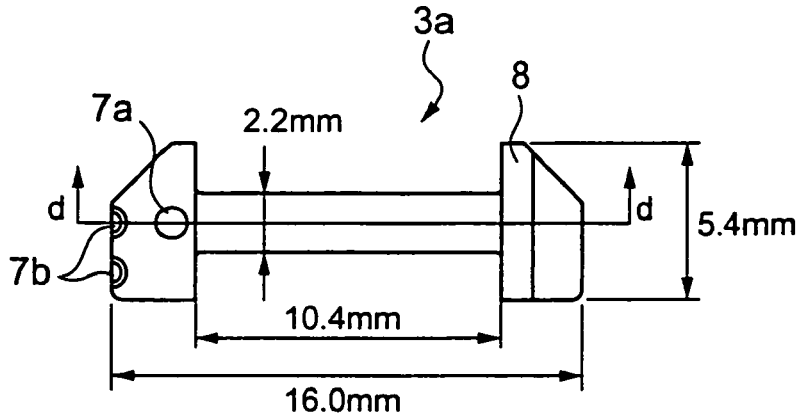
FIG. 6A is a top view showing an upper case forming the core material case which is used for the antenna of the present invention.
Figure 6B:
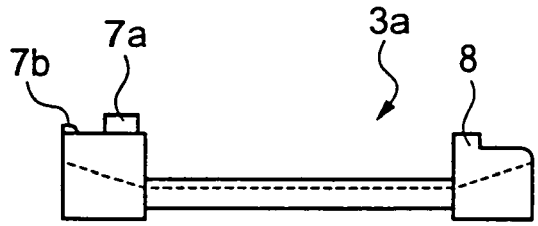
FIG. 6B is a side view of the upper case in FIG. 6A.
Figure 6C:
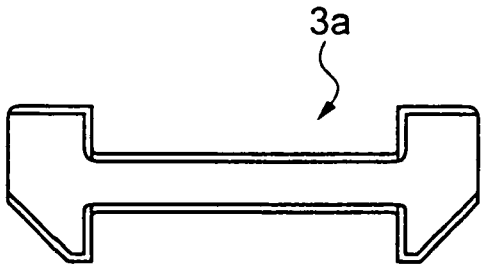
FIG. 6C is a bottom view of the upper case in FIG. 6A.
Figure 6D:
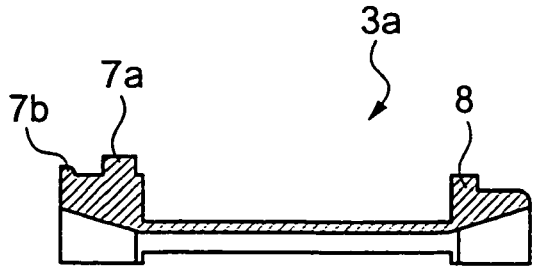
FIG. 6D is a section view taken along the line d-d of FIG. 6A.
Figure 7A:
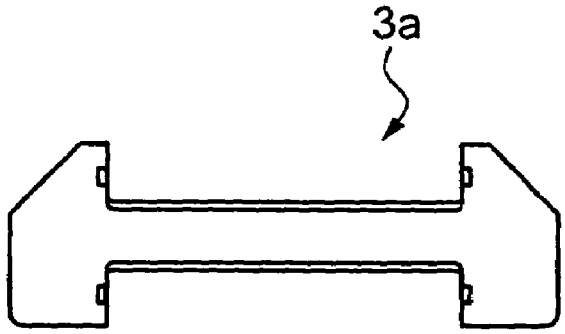
FIG. 7A is a top view showing a lower case forming the core material case which is used for the antenna of the present invention.
Figure 7B:
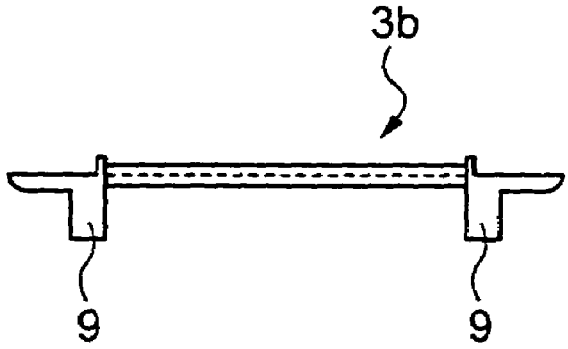
FIG. 7B is a side view of the lower case in FIG. 7A.
Figure 7C:
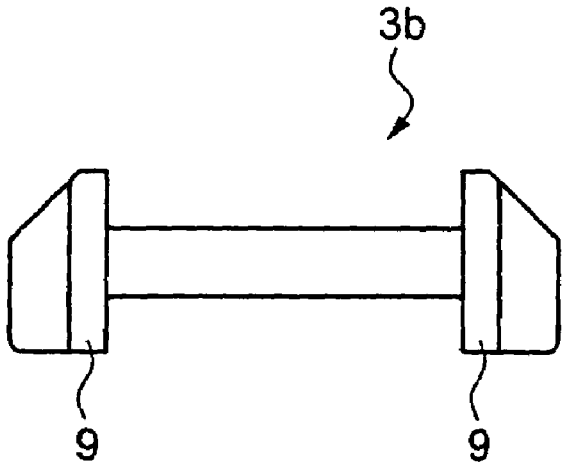
FIG. 7C is a bottom view of the lower case in FIG. 7A.

The core material case 3 that contains the core material 11 therein comprises the upper case 3*a* and the lower case 3*b* as shown in FIGS. 5-7.

The core material case 3 forms a container 30 which is a space formed between the upper case 3*a* and the lower case 3*b* when they are incorporated, that is, between the under surface of the upper case 3*a* and the top surface of the lower case 3*b*. The container 30 contains the core material 11.

The core material case 3 comprises a central portion 5 which covers a portion corresponding to the core central portion 1*a* of the thin plate 1 forming the core material 11, end portions 6*a* and 6*b* each of which is provided at each end of the central portion 5 and cover a portion corresponding to the core end portions 1*b* of the thin plate 1 forming the core material 11. The space of the container 30 in the end portions 6*a*, 6*b* is gradually widened toward a head of the each end portion 6*a*, 6*b* corresponding to the shape of the core end portions 1*b* of the thin plate 1 and the shape of the core material 11 corresponding to the core end portions 1*b*.

A positioning pin 7*a* for carrying out positioning of the connection member 40 and two positioning protrusions 7*b* are formed on a portion corresponding to the one end portion 6*a* on a top surface of the upper case 3*a*. An upper flange 8 is formed on the top surface of a portion corresponding to the other end portion 6*b* of the upper case 3*a*. The upper flange 8 protrudes to the height same as the top surface of the one end portion 6*a*.

A lower flange 9 is formed at an under surface of each end portion 6*a*, 6*b*. Each of the lower flanges 9 protrudes the same height.

An example of a specific dimension of the core material case 3 is shown in FIGS. 5-6. In the figures, the length of the core material case 3 in the longer direction is 16.0 mm, the length of the central portion 5 in the longer direction is 10.4 mm, the width of the central portion 5 in the shorter direction is 2.2 mm, the width of the end portions 6*a*, 6*b* is 5.4 mm, the thickness of the central portion 5 is 1.6 mm, and the length from the under surface of the lower flange 9 to the top surface of the upper flange 8 (from the under surface of the lower flange 9 to the top surface of the end portion 6*a*) is 4.8 mm.

Figure 8:
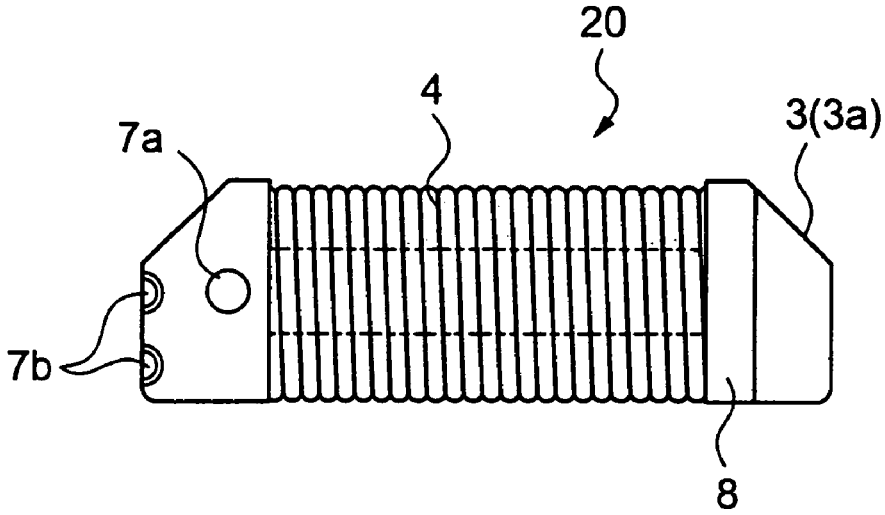
FIG. 8 is a front view showing an antenna body of the antenna according to the present invention.
Figure 9:
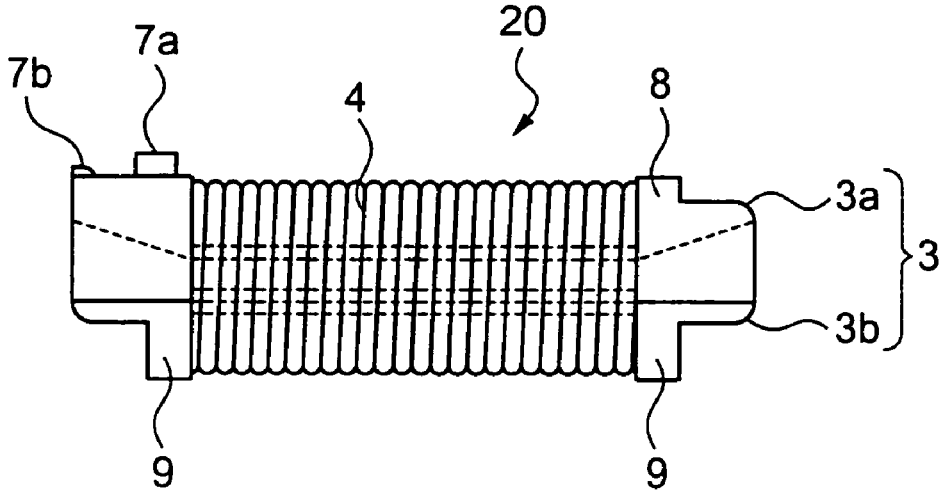
FIG. 9 is a side view showing the antenna body of the antenna according to the present invention.

The coil 4, for example, is a copper wire and is indirectly wound around the core material 11 through the core material case 3. As shown in FIGS. 8 and 9, the coil 4 is wound around the central portion 5 of the core material case 3 in approximately even thickness so as to make side surfaces of the coil 4 and each side surfaces of the end portions 6*a*, 6*b* of the core material case 3 approximately be in the same plane. Specially, the coil 4 is wound to make top and under surfaces of the coil 4 and the top surface of the upper flange 8 and the under surface of the lower flange 9 approximately be in the same plane, respectively.

For example, the coil 4 of copper wire having a diameter of 0.1 mm is wound around the central portion 5 1195 times (14 layers).

The connection member 40 comprises a flexible substrate, and at one end portion 41 of which is provided with an positioning hole 43 through which the positioning pin 7*a* formed on the end portion 6*a* of the core material case 3 (the upper case 3*a*) is inserted to carry out positioning of the connection member 40 to the end portion 6*a*. A positioning groove 44 is provided at an edge portion 41a of the one end portion 41. The positioning groove 44 is engaged with the positioning protrusion 7*b* which is formed on the end portion 6*a* of the core material case 3 (the upper case 3*a*) to limit the rotation of the connection member 40 around the positioning pin 7*a*. The connection member 40 is positioned at a predetermined position of the antenna body 20 (or the end portion 6*a* of the core material case 3 (the upper case 3*a*)) by aligning the positioning pin 7*a* and the positioning protrusion 7*b* with the positioning hole 43 and the positioning groove 44, respectively, to be attached.

The other end portion 42 of the connection member 40 is formed so as to be attached to electronic equipment with electrically connectable to a circuit substrate (not shown) thereof.

Two lead wires 45 are provided between the one end portion 41 and the other end portion 42 of the connection member 40. A lead terminal 45*a* is formed at the one end portion 41 for each lead wire 45. At the lead terminal 45*a*, each end of the coil 4 of the antenna body 20 protrudes from the rear surface side of the connection member 40 to the front surface side thereof through a through-hole (not shown), and is attached by applying solder 46 in a state of electrically being connected. The lead wire 45 at the other end portion 42 of the connection member 40 is electrically connected to the circuit substrate (not shown) of the electronic equipment, so that the connection member 40 electrically connects the antenna body 20 and the electronic equipment (not shown).

A method for manufacturing the antenna 100 according to the present invention will be described.

In a first step, a plurality of thin plates 1 is laminated while matching a flat shape thereof. After laminating a predetermined number of thin plates 1, the spacer 2 is placed at the core end portions 1*b* that are the both ends of the thin plate 1. In this case, a tip of an acute angle side of the spacers 2 with a wedge shape which are placed at both ends of the thin plate 1 should face toward the center from both ends and oppose each other.

Moreover, a plurality of thin plates 1 is laminated thereon. The thin plate 1 is laminated as is described above at the core central portion 1*a*. However, the core end portion 1*b* is bent by the spacer 2 which is placed at both ends of the thin plate 1 in the vicinity of the border of the core central portion 1*a* and the core end portion 1*b*. Accordingly, the thin plate 1 is laminated while being bent toward the thickness direction of the thin plate 1 so as to be separated from the core end portion 1*b* which is laminated before the spacer 2 is placed.

Since the spacer 2 is placed between predetermined thin plates 1 when a predetermined number of thin plates 1 are laminated to form the core material 11, the both ends of the core material 11 can be widened toward the thickness direction thereof.

In a second step, the core material 11 which is formed as described above is sandwiched from the thickness direction of the core material 11 by the upper case 3*a* and the lower case 3*b*, and is contained in the container 30 which is formed between the upper case 3*a* and the lower case 3*b*.

In a third step, the coil 4 is wound indirectly around the core material 11 through the central portion 5 of the core material case 3 which is formed by combining the upper case 3*a* and the lower case 3*b* in approximately even thickness. The coil 4 is wound so as to make the side surfaces of the coil 4 and the each side surfaces of the end portions 6*a*, 6*b* of the core material case 3 approximately be in the same plane as shown in FIG. 8, and to make the top and under surfaces of the coil 4 and the top surface of the upper flange 8 and the under surface of the lower flange 9 approximately be in the same plane, respectively, as shown in FIG. 9. Thereby, the antenna body 20 is formed.

The positioning pin 7*a* and the positioning protrusion 7*b* of the antenna body 20 side are aligned with the positioning hole 43 and the positioning groove 44 of the connection member 40 side, respectively, so that the connection member 40 is positioned at a predetermined position of the antenna body 20 (or the end portion 6*a* of the core material case 3 (the upper case 3*a*)) and attached.

In this way, the antenna 100 is assembled and manufactured.

An embodiment of the above-described antenna will be explained with a comparative example.

The antenna 100 of the present invention shown in FIGS. 1-3 is manufactured. In the antenna 100, the Q-values for each of the electric waves of 40 kHz and 60 kHz were measured under the condition that the inductance (L) is about 20 mH. The result will be shown in table 1.

As a comparative example, an antenna is manufactured. In the antenna, a core material is formed only by laminating the thin plate 1 without using the spacer 2 when assembling the antenna. The Q-values for each of the electric waves of 40 kHz and 60 kHz were measured under the condition that the inductance (L) is about 20 mH. The result will be shown in table 2.

TABLE 1

| | 40 KHz | | 60 KHz | |
|---|---|---|---|---|
| No. | L (mH) | Q | L (mH) | Q |
| 1 | 19.99 | 98.0 | 20.57 | 95.7 |
| 2 | 19.89 | 98.0 | 20.50 | 96.4 |
| 3 | 20.00 | 92.7 | 20.60 | 88.1 |
| 4 | 20.37 | 96.7 | 20.97 | 93.7 |
| 5 | 20.12 | 96.7 | 20.22 | 95.5 |
| 6 | 20.3 | 98.3 | 20.92 | 95.6 |
| 7 | 20.05 | 99.5 | 20.64 | 96.6 |
| 8 | 20.15 | 99.4 | 20.77 | 96.6 |
| 9 | 20.35 | 91.3 | 20.97 | 86.5 |
| 10 | 20.25 | 99.6 | 20.87 | 97.3 |
| AVERAGE | 20.15 | 97.02 | 20.70 | 94.20 |

TABLE 2

| | 40 KHz | | 60 KHZ | |
|---|---|---|---|---|
| No. | L (mH) | Q | L (mH) | Q |
| 1 | 20.91 | 86.5 | 21.61 | 86.3 |
| 2 | 20.55 | 86.4 | 21.22 | 84.0 |
| 3 | 20.66 | 81.9 | 21.30 | 77.3 |
| AVERAGE | 20.707 | 84.93 | 21.377 | 81.67 |

As shown in Table 1, in the antenna 100 comprising the core material 11 which is widened at both ends (core end portions 1*b*) of the core material (thin plate 1) by the spacer 2 in the thickness direction, the average Q-value for the electric wave of 40 kHz is 97.02, and the average Q-value for the electric wave of 60 kHz is 94.20. As shown in Table 2, in an antenna for comparison comprising a rod-like core material which is formed only by laminating the thin plate 1 without both ends of the core material being widened, the average Q-value for the electric wave of 40 kHz is 84.93, and the average Q-value for the electric wave of 60 kHz is 81.67.

Accordingly, since the Q-value of the antenna 100 in the present invention is larger than that of the comparison antenna, it is to be understood that the reception sensitivity of the antenna 100 is better than that of the antenna for comparison. That is, the reception sensitivity of the electric wave is improved by widening the both ends of the core material 11 using the spacer 2.

The core material 11 provided in the antenna 100 is formed by laminating a plurality of thin plates 11 that is made of amorphous. Further, the both ends of the core material 11 are widened in the thickness direction of the core material 11. Thus, the reception sensitivity of the electric wave can be improved.

Specially, the thin plate 1 used in the embodiment has an approximately H shape from the plan view with the core end portion 1*b* formed at both ends of the core central portion 1*a* in the longer direction wider than the width of the core central portion 1*a*. Thus, the both ends of the core material 11 have a shape larger than the core central portion 1*a* from the plan view. In the invention, the both ends of the core material 11 are widened in the thickness direction of the core material 11, so that the size of the both ends can be enlarged and the reception sensitivity of the electric wave can be improved more.

Figure 10:
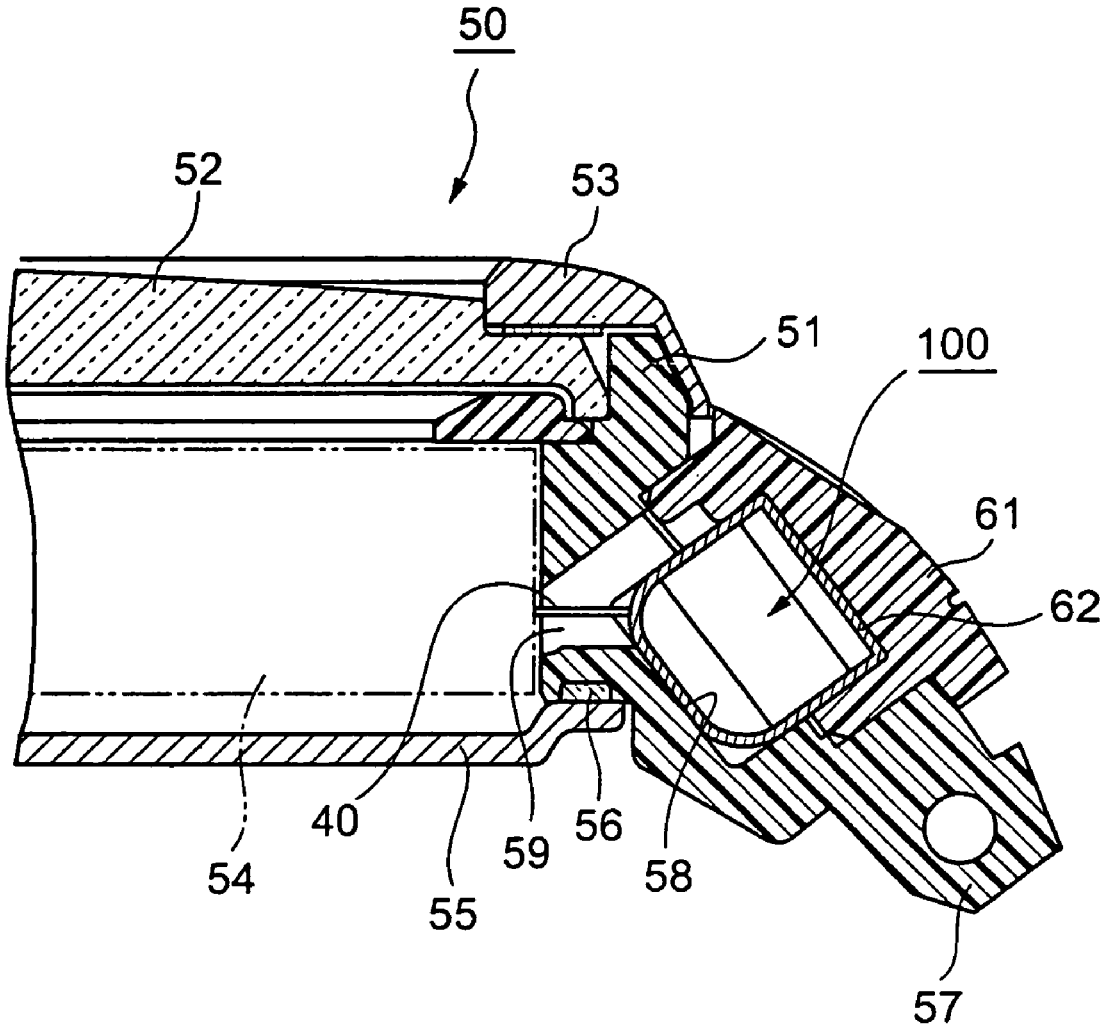
FIG. 10 is an enlarged section view showing the main portion of an electronic wristwatch in which the antenna of the present invention is contained.

FIG. 10 is an enlarged section view showing the main portion of an electronic wristwatch 50 in which the antenna in the present invention is contained. The electronic wristwatch 50 comprises a wristwatch case 51 made of synthetic resin. A watch glass 52 is provided at an upper portion of the wristwatch case 51, and a bezel 53 made of metal is attached on the periphery of the upper portion of the wristwatch case 51. Further, a watch module 54 is contained inside the wristwatch 51 and a back lid made of metal is attached at a lower portion of the wristwatch 51 through a waterproof ring 56.

The watch module 54 comprises at least one of an analogue function and a digital function that are not shown. The analogue function comprises an analogue movement contained in a housing. An axis of a pointer protrudes upwardly from a dial, and a pointer such as an hour hand, a minute hand or the like is attached on an upper end portion of the axis of the pointer so that the pointer moves above the dial. The digital function comprises a flat type display panel disposed above the housing such as a liquid crystal display panel, EL panel (electroluminescence panel) or the like. The display panel is formed to electrically display information such as the time. The watch module 54 comprises a breadboard (pot shown) for driving the analogue movement or the display panel.

A band attaching portion 57 is formed at both sides of the 12 o'clock side and the 6 o'clock side of the wristwatch case 51 (only the 12 o'clock side is shown in FIG. 10), which protrudes diagonally in downward direction. An antenna containing concavity 58 is provided at a side of the wristwatch case 51 at which the band attaching portion 57 at the 12 o'clock side is positioned. The antenna containing concavity 58 which is for containing the antenna 100 is configured so as to be exposed to an outer surface of the wristwatch case 51 and be provided with a communicating hole 59 which is communicated with the inside of the wristwatch case 51. A protection cover 61 for protecting the antenna 100 by covering the antenna 100 is attached on the outer surface of the wristwatch case 51 that faces to the antenna containing concavity 58 by deposition. The protection cover 61 is formed by synthetic resin so as not to shield the electric wave. The antenna body 20 of the antenna 100 is adhered to the antenna containing concavity 58 and the protection cover 61 by a double-faced adhesive tape 62. The connection member 40 of the antenna 100 is placed into the watch module 54 in the wristwatch case 51 through the communicating hole 59 to be electrically connected to the breadboard (not shown).

The shape of the core material in which both ends of the core material are widened in the thickness direction is not limited to the shape of the above-described core material 11.

Figure 11:
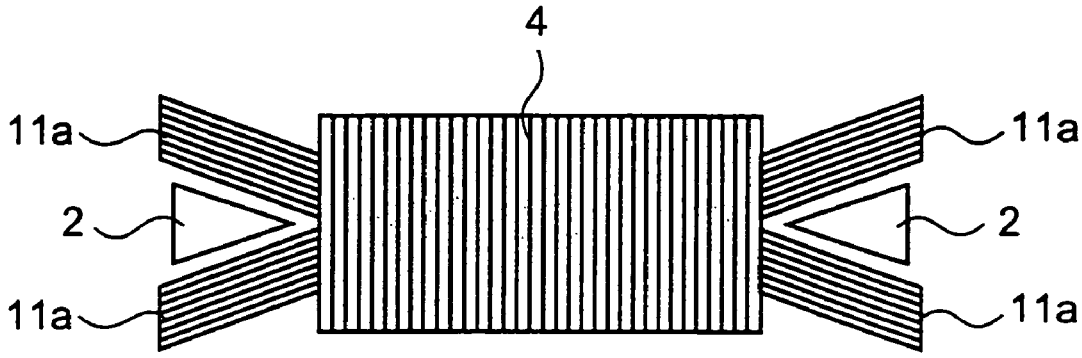
FIG. 11 is a view showing a frame format of variation 1 of the antenna according to the present invention.

For example, as the variation 1 shown in FIG. 11, the core material 11*a* may have a structure in which both sides of the core material 11*a* across the spacer 2 are widened to the both sides by the spacer 2 in the thickness direction. In this structure, the open area ratio is increased as compared to the structure in which one side of the core material 11 is widened. Thus, the reception sensitivity is further improved.

Figure 12:
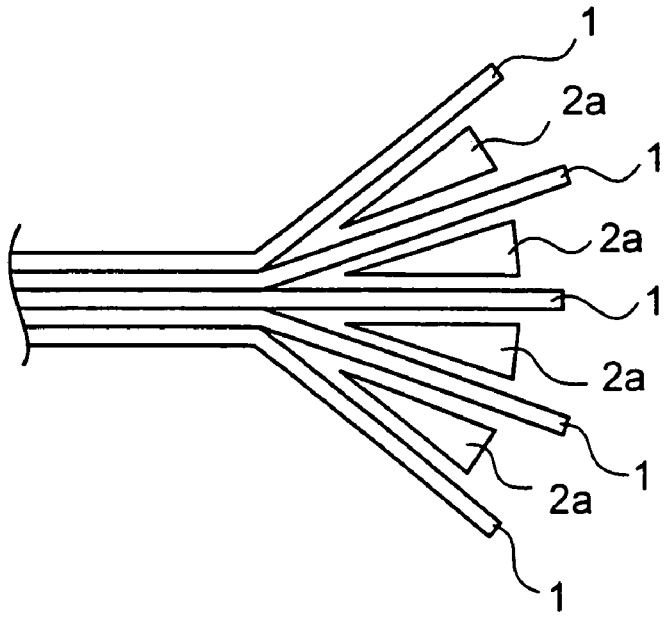
FIG. 12 is a view showing a frame format of variation 2 of the antenna according to the present invention.

For example, as the variation 2 shown in FIG. 12, the core material 11*b* may have a structure in which the spacer 2*a*. is placed between each thin plate 1 so that each thin plate 1 is separated each other and both ends of the core material 11*b* is widened in the thickness direction.

Figure 13:
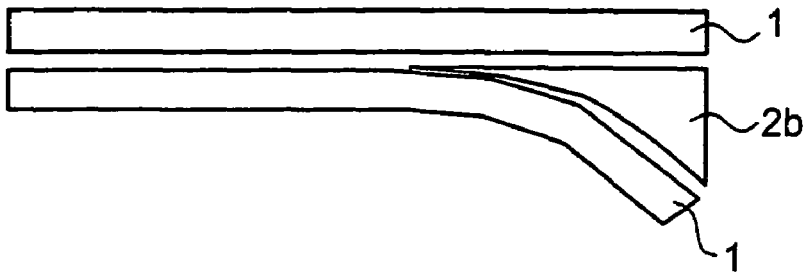
FIG. 13 is a view showing a frame format of variation 3 of the antenna according to the present invention.

For example, as the variation 3 shown in FIG. 13, the spacer 2*b* may have a shape that is suitable for separating each thin plate 1. Further, for example, as the variation 4 shown in FIG. 14, a plurality of the spacers 2*c* may be placed between thin plates 1.

Figure 14:
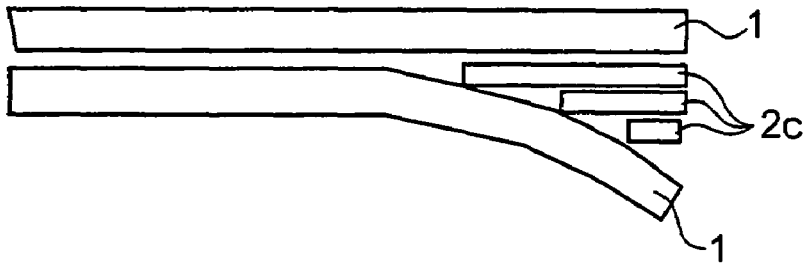
FIG. 14 is a view showing a frame format of variation 3 of the antenna according to the present invention.

In the shape of the spacer shown in FIG. 13 or 14, bending stress is not regionally concentrated as in the case of using the spacer shown in FIGS. 1-3. Accordingly, the bending stress can be dispersed, and, for example, a crack or the like which is produced by a stress concentration can be prevented.

Figure 15:
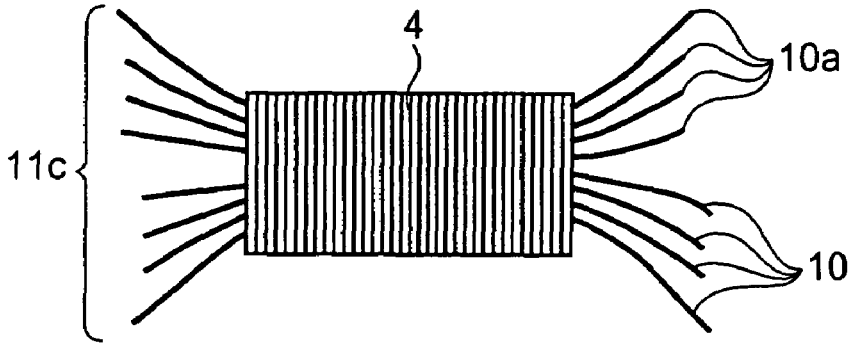
FIG. 15 is a view showing a frame format of variation 4 of the antenna according to the present invention.

For example, as the variation 4 shown in FIG. 15, the core material 11*c* may be formed by binding a plurality of wire rods 10 made of amorphous, and a tip portion 10*a* of the wire rod 10 may be widened from the center of a bundle in the outer direction at both ends.

In the core material of the antenna in the variation 4, the both ends of the core material 11*c* which is formed by binding a plurality of wire rods 10 made of amorphous is widened from the center of the bundle. Thus, the diameter of the both ends of the core material 11*c* is larger than that of the central portion, and the reception sensitivity of the electric wave can be improved. Accordingly, the effect similar to the antenna in FIGS. 1-3 can be obtained.

In the embodiment, the spacer is placed and sandwiched between the thin plates to widen the core material in the thickness direction, however, the present invention is not limited thereto. A space may be formed between thin plates without using the spacer to widen the core material in the thickness direction.

The spacer may be inserted between the predetermined thin plates after forming the core material 11 as well as placing and sandwiching the spacer when laminating the thin plate 1.

For example, a ferrite may be used as a material for the spacer.

The thin plate or the spacer may be fixed by adhering or the like after the lamination thereof.

Further, it is to be understood that the specific detail structure or the like can be changed accordingly.

What is claimed:

1. An antenna comprising:

a core material which includes a plurality of thin plates made of a magnetic material and laminated together, the plurality of thin plates being laminated at a central portion of the core material and divided at both end portions of the core material to widen the end portions in a thickness direction of the core material;

a core material case which covers the central portion of the core material and circumferential side faces of both end portions of the core material, which are widened in the thickness direction; and a coil which is wound around a central portion of the core material case.

2. The antenna as claimed in claim 1, wherein the magnetic material is amorphous.

3. The antenna as claimed in claim 1, wherein a spacer is provided between at least two thin plates of the plurality of the thin plates at the both end portions of the core material.

4. The antenna as claimed in claim 1, wherein the antenna is adapted to receive a long wave.

5. The antenna as claimed in claim 1, wherein the antenna is adapted to receive an electric wave that includes time data.

6. The antenna as claimed in claim 1, wherein the antenna is contained in a case of a wristwatch.

* * * * *